United States Patent [19]

Makabe et al.

[11] Patent Number: 4,570,561

[45] Date of Patent: Feb. 18, 1986

[54] ELECTRONIC SEWING MACHINE

[75] Inventors: Hachiro Makabe, Kanagawa; Takeshi Kongoh, Tokyo, both of Japan

[73] Assignee: Janome Sewing Machine Industry Co., Ltd., Tokyo, Japan

[21] Appl. No.: 602,327

[22] Filed: Apr. 20, 1984

[30] Foreign Application Priority Data

Apr. 22, 1983 [JP] Japan ..... 58-70004

[51] Int. Cl.[4] ..... D05B 97/04; D05B 3/02

[52] U.S. Cl. ..... 112/454; 112/121; 112/451

[58] Field of Search ..... 112/158 E, 158 B, 121, 112/121.12, 262.1, 316, 317, 266.1, 65, 69, 454, 451; 66/2

[56] References Cited

U.S. PATENT DOCUMENTS

| | | | |
|---|---|---|---|
| 431,583 | 7/1890 | Helwig | 112/121 |
| 3,599,583 | 8/1971 | Berman | 112/121.12 |
| 4,182,252 | 1/1980 | Yoneji et al. | 112/317 |
| 4,188,900 | 2/1980 | Garron et al. | 112/158 B X |
| 4,250,821 | 2/1981 | Miyao et al. | 112/158 B |
| 4,345,532 | 8/1982 | Eguchi | 112/317 X |
| 4,434,729 | 3/1984 | Davidson | 112/158 E X |

*Primary Examiner*—Peter Nerbun

*Attorney, Agent, or Firm*—Frishauf, Holtz, Goodman & Woodward

[57] ABSTRACT

An electronically controlled sewing machine includes an electronic memory storing a plurality of stitch control data for respective stitch patterns, including a darning pattern composed of a number of vertical straight stitch lines sequentially produced in forward and reverse fabric feeding directions. A number of signals which are generated each time a fabric penetrating needle ascends above the fabric between the first stitch and the last stitch of each vertical straight stitch line of the darning pattern, are counted up by a counter to produce a corresponding value signal. The latter signal is compared with another value signal latched in a latch circuit in response to operation of a turning point designating switch adapted to designate a number of stitches for each vertical straight stitch line of the darning pattern. When the value signals coincide with each other, the count-up operation of the counter is reset for producing a subsequent vertical straight stitch line.

3 Claims, 4 Drawing Figures

ELECTRONIC SEWING MACHINE

BACKGROUND OF THE INVENTION

The invention relates to an electronic sewing machine storing stitch control data for controlling the needle position and fabric feed amount in accordance with a selected stitch pattern, and more particularly to an electronic sewing machine also capable of variably controlling the stitches of a darning stitch pattern.

Conventionally, a broken or worn out portion of a garment is darned by a sewing machine while the garment is manually displaced with respect to the needle. Such a darning operation often fails to make uniform stitches in the broken or worn out portion of the garment.

SUMMARY OF THE INVENTION

This invention has been provided to eliminate the defects and disadvantages of the prior art.

It is an object of the invention to provide an electronic sewing machine according to which a variable pattern of darning stitches may be automatically produced in accordance with the size of a broken or worn out portion of the garment.

According to the invention there is provided an electronic sewing machine comprising, in combination, an electronic memory for storing stitch control data for controlling a needle position and a fabric feed amount per stitch of a pattern selected from a number of different stitch patterns including a darning pattern, the darning pattern being comprised of plural series of straight stitch lines sequentially and alternately produced in forward and reverse fabric feeding directions in a predetermined width of region, the control data including data defining a fixed number of stitches at initial and final portions of the darning portion and data defining a variable number of stitches in each of the straight stitch lines; signal generating means operated in synchronism with rotation of a drive shaft of the sewing machine to produce a timing signal for reading out the data of a selected pattern from the memory; counter means for counting up a number of the timing signals produced by the signal generating means; data discriminating means operated in response to the data defining a variable number of stitches in each of the straight stitch lines, thereby nullifying the timing signal to the memory and simultaneously resetting the counter means for starting the count-up operation; switch means operated to designate a turning point of each series of the straight stitch lines of the darning pattern; a latch circuit responsive to operation of the switch means to latch the number value counted up by the counter means; and means for comparing the value latched by the latch circuit and the number value counted up by the counter means, the comparing means being operated when the counter value has come to be equal to the latched value to thereby nullify the timing signal to the memory and simultaneously reset the counter means for starting the count-up operation.

BRIEF DESCRIPTION OF DRAWINGS

The foregoing and further objects and advantages of the invention can be fully understood from the following detailed description when read in conjunction with the accompanying drawings in which.

PREFERRED EMBODIMENT OF THE INVENTION

Figure 1:
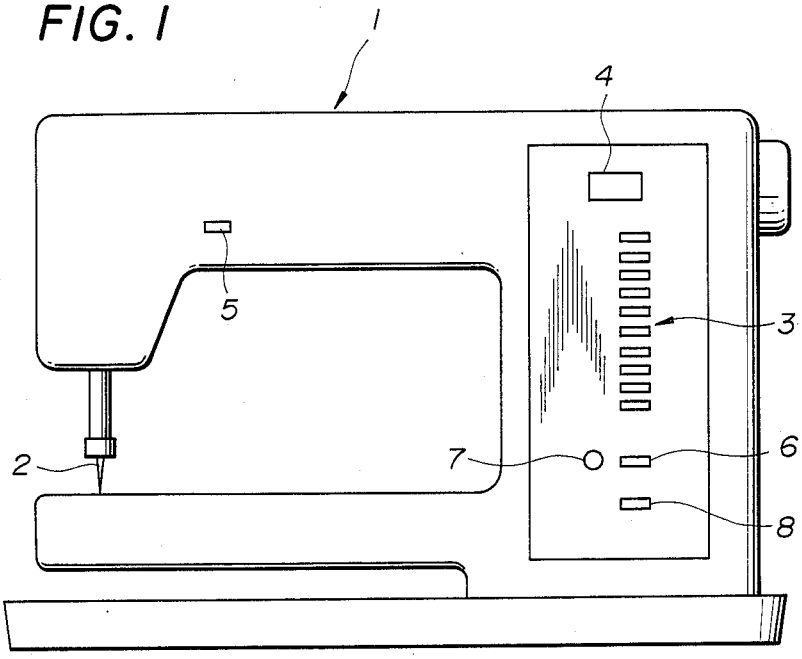
FIG. 1 is a schematic front elevational view of an electronic sewing machine of the invention.

Specifically referring to FIG. 1, in a housing 1 of an electronic sewing machine there is provided an electronic memory element (not shown) for storing a plurality of stitch control data for different stitch patterns including a darning stitch pattern, each of which may be selected by operating ten-key switches 3 to designate a two-digit pattern number corresponding to the stitch pattern. The selected pattern number is represented at an indicator 4.

Figure 2A:
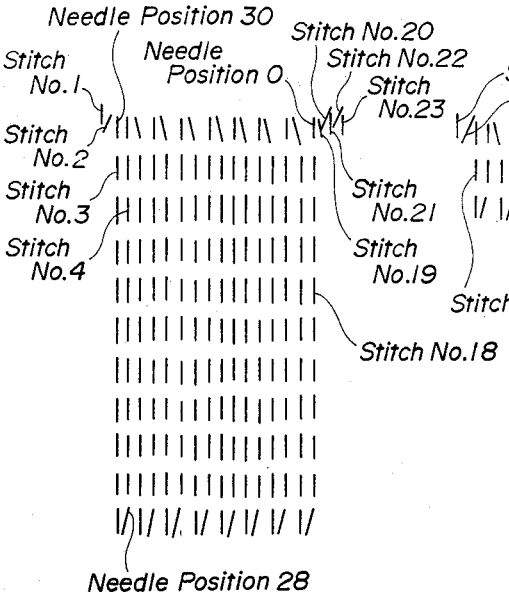
FIGS. 2A and 2B show examples of darning stitch patterns produced according to the invention.
Figure 2B:
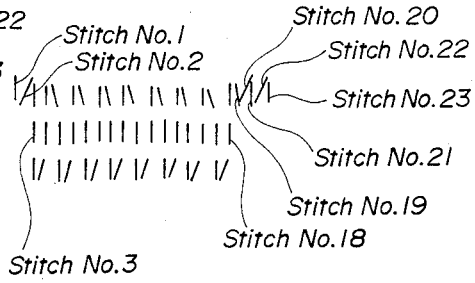

When it is desired to darn a broken or worn out portion of a garment, the operator is required to selectively operate the ten-key switches 3 so as to designate the darning stitch pattern and then to drive the sewing machine. When the first series of straight stitches forming a part of the darning stitch pattern has been finished in a desired length, the operator is required to operate a turning point designating switch 5, and is then required to operate a memory switch 6 to cause the sewing machine to memorize the vertical length of the darning pattern, so that a series of a predetermined number of straight stitches may be repeatedly formed in the forward and reverse fabric feeding directions. The darning pattern as shown in FIGS. 2A and 2B is thus produced automatically, in which a predetermined number of straight stitch series are laterally arranged with a predetermined space provided therebetween, in the laterally extended maximum region which may be traversed by a laterally swingable needle 2. For instance, FIG. 2A shows an example of a darning pattern composed of eleven stitch steps, and FIG. 2B shows an example of the darning pattern composed of three stitch steps. An indicator 7, e.g., a light emitting diode is lit when the switches 5 and 6 are in the operative conditions. A switch 8 cancels the function of the memory switch 6.

Figure 3:
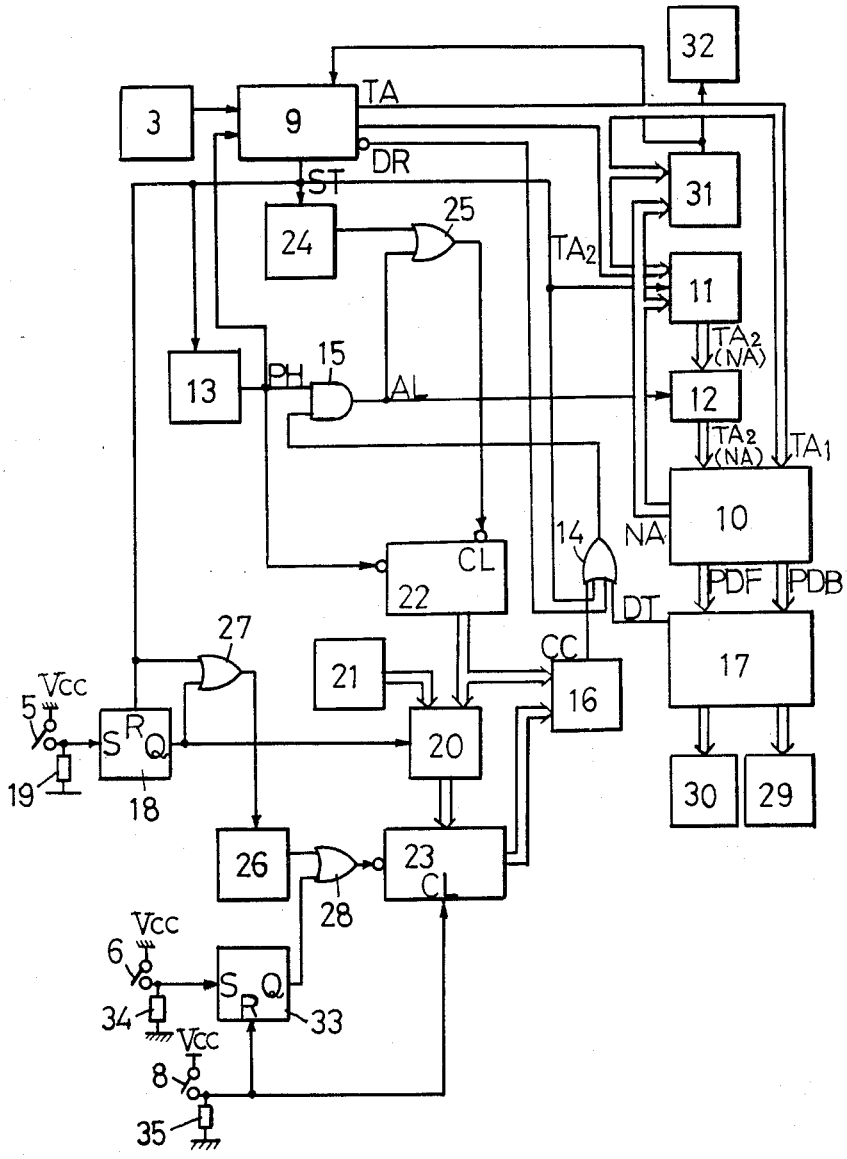
FIG. 3 is a block diagram of a control circuit of the invention.

FIG. 3 is a block diagram of a control circuit of the invention. More particularly, the selective operation of the pattern selecting switches 3 to select a desired one of the stitch patterns will give a corresponding number signal to a pattern number control unit 9, which is then operated to produce an address signal TA for reading out the initial data for the first stitch of the selected pattern, and at the same time produces a start signal ST of high level. The control unit 9 is arranged to detect whether or not the selected pattern is a darning stitch pattern and in the affirmative case produce a darning signal DR of low level. The address signal TA has a first part $TA_1$ applied to a memory 10 storing stitch control data and a second part $TA_2$ transmitted to a multiplexer 11. The address signal $TA_2$ is then issued from the multiplexer 11 while the latter receives a high level signal ST from the control unit 9. When the start signal ST is, in turn, at the low level, the multiplexer 11 produces a next address signal NA in place of the second address signal $TA_2$. A latch circuit 12 latches the address signal $TA_2$ or NA each time it receives a high level address latch signal AL.

A drive shaft phase signal generator 13 produces a pulse signal at the moment it receives the high level start signal ST from the control unit 9. The high level start signal ST is also connected to one input of an OR circuit 14 which thereby produces a high level output signal. Thus, an AND circuit 15 receives at both inputs the high level signals to produce a high level signal AL. Further, during the stitching operation, the drive shaft phase signal generator 13 produces a high level phase signal PH to one input of the AND circuit 15 each time the needle 2 ascends to reach above the fabric. When a stitch pattern other than the darning pattern is selected, a high level darning signal DR is supplied from the control unit 9 to one input of OR circuit 14, and the other input of the AND circuit 15 is connected to the high level output of the OR circuit 14, when the darning stitch patern is selected, a low level darning signal DR is transmitted to an input of the OR circuit 14. A high level output of the OR circuit 14 will, however be issued toward the AND circuit 15 on condition that a counter coincidence signal CC from a comparator 16 and/or a darning lock stitch signal DT from a data discriminating circuit 17 are at a high level.

With the address signals $TA_1$ and $TA_2$ being applied, the memory 10 produces the needle position control data PDB and the feed amount control data PDF both for the first stitch of the selected pattern, and the next address signal NA for reading out the next stitch control data.

When the needle 2 descends to penetrate the fabric and then the phase signal PH is changed to the low level, the start signal ST simultaneously becomes the low level. Then, the multiplexer 11 generates another next address signal NA.

When the phase signal PH is turned again to the high level, the next address signal NA supplied from the multiplexer 11 is latched in the latch circuit 12 whereby the next needle position control data PDB are read and the fabric feed amount control data PDF for the next stitch of the selected pattern.

A flip-flop circuit 18 will, upon receipt of the start signal ST at a reset terminal R thereof, produce a low level signal at the output Q. A set terminal S of the flip-flop circuit 18 is connected to the turning point designating switch 5 which is normally opened, and the output Q of the flip-flop circuit 18 will be brought to the high level by manual operation of the switch 5. A pull down resistor 19 is provided as shown.

A multiplexer 20 is operated in response to the low level output Q from the flip-flop circuit 18 to give a stitch value latch circuit 23 a maximum value stored previously in a maximum stitch memory 21. On the other hand, the multiplexer 20 is operated in response to a high level output Q to give the stitch value latch circuit 23 a value which has been counted up by a stitch counter 22. The memory 21 stores a predetermined number of stitch steps, for example eleven, of the darning pattern, so that the pattern as shown in FIG. 2A is produced. The stitch counter 22 counts up the stitch each time it is produced, and more particularly, is reset at a falling point of the signal from the OR circuit 25, one of the inputs of which is connected to a monostable multivibrator 24 and the other input of which is connected to the output of the AND circuit 15, so as to start counting the number of falling points of the signal from the drive shaft phase signal generator 13. The counting operation of the counter 22 is stopped due to a fresh falling point of the signal from the OR circuit 25.

A monostable multivibrator 26 is made effective, via an OR circuit 27, when the pattern is selected to make the start signal ST to be the high level and/or when the switch 5 is operated to make the signal from the output Q of the flip-flop circuit 18 to be the high level. The latch circuit 23 will latch the signal from the multiplexer 20 at the falling point of the signal received from the monostable vibrator 26 via an OR circuit 28, and then produce the signal to the comparator circuit 16, in which the stitch counting pulse from the counter 22 is compared with the standard stitch value from the latch circuit 23. Thus, when the stitch counting pulse comes to coincide with the standard stitch value, a high level signal is given to the OR circuit 14, whereby the pulse signal from the pulse generator 13 is converted to the address latch signal AL which is supplied from the AND circuit 15.

The pattern data memory 10 stores data for controlling the needle position and feeding amount per stitch of the darning stitch pattern, as shown in the following Table.

TABLE

| | control data | | | control data | |
|---|---|---|---|---|---|
| stitch No. | needle position | reed amount | stitch No. | needle position | reed amount |
| 1 | 30 | 19 | 13 | 10 | 30 |
| 2 | 30 | 11 | 14 | 8 | 0 |
| 3 | 30 | 30 | 15 | 6 | 30 |
| 4 | 28 | 0 | 16 | 4 | 0 |
| 5 | 26 | 30 | 17 | 2 | 30 |
| 6 | 24 | 0 | 18 | 0 | 0 |
| 7 | 22 | 30 | 19 | 0 | 19 |
| 8 | 20 | 0 | 20 | 0 | 11 |
| 9 | 18 | 30 | 21 | 0 | 19 |
| 10 | 16 | 0 | 22 | 0 | 11 |
| 11 | 14 | 30 | 23 | 0 | 15 |
| 12 | 12 | 0 | | | |

As shown in the Table, only the basic data for the darning pattern are stored in the memory 10. With respect to the needle control data, the data 0 and 30 indicate the maximum width of a region divided with 30 needle positions, which may be progressively traversed by the swingable needle 2. Actually, the needle position control data 0 and 30 correspond to the rightmost and leftmost stitches of the darning pattern as shown in FIG. 2B. In the same manner, the feed amount control data 0 and 30 define the maximum fabric feeding amount in the reverse and forward directions respectively, which is also divided into 30 feed steps. This means that the data 15 indicates that the fabric is not transported. The data at the stitch Nos. 1, 2 and 19–23 are provided to make the initial and final lock stitches of the darning pattern as particularly shown in FIG. 2B, and are used to produce a fixed number of stitches. The initial and final lock stitches are formed by fixing the needle position and, at the same time, transporting the fabric a minimum amount repeatedly in the forward and reverse directions. The data at the stitch No. 3 are provided to repeatedly produce the straight stitches in the leftmost line of the darning pattern as shown in FIGS. 2A and 2B. The data at the stitch No. 4 are provided to repeatedly produce the straight stitches in the second line from the left. However, the number of the straight stitches is determined in dependence upon the value latched at the stitch value latch circuit 23. Thus, the data at the stitch Nos. 3–18 may be used to produce a variable number of stitches in each vertical straight stitch line of the darning pattern.

The data discriminating circuit 17 produces the needle position control data PDB and the feeding amount control data PDF to a needle control unit 29 and a feed control unit 30 respectively, and also makes a lock stitch signal DT at a high level which is connected to an input of the OR circuit 14 if the stitch control data are those of the stitch Nos. 1, 2 and 19–23. The next address signal NA from the memory 10 is given to a comparator circuit 31, which compares the next address signal NA and the initial address signal TA supplied thereto from the control unit 9, and when the next address signal NA coincides with the initial address TA, the comparator circuit 31 will generate a high level signal to a brake unit 32 to stop the sewing machine, and cause the control unit 9 to return its initial stage.

The set terminal S of a flip-flop circuit 33 is connected to the memory switch 6, so that due to operation of the memory switch 6 the high level signal from the output Q is transmitted to the OR circuit 28, in which case the output data from the latch circuit 23 is caused to be fixed independently of the signal from the monostable multivibrator 26, thereby repeatedly producing the darning stitches as shown in FIG. 2B in accordance with the designated number of stitches (for example, three stitches in FIG. 2B). The flip-flop circuit 33 is reset by operation of the switch 8. Pull-down resistors are provided as shown.

The operation of the electronic sewing machine of this invention is as follows: When the darning pattern is selected by so operating the pattern selecting switches 3, the control unit 9 will produce the low level darning signal DR. The address signals $TA_1$ and $TA_2$ are given to the memory 10, to thereby operate the needle and feed control units 29 and 30 in accordance with the data for stitch No. 1 of the Table, and produce the first stitch at the left end of the darning pattern. At this time, the lock stitch signal DT is at the high level so as to make the AND circuit 15 effective. The stitch counter 22 is reset at a falling point of the drive shaft phase signal PH from the phase signal generator 13. The predetermined value of the maximum number of stitches, for example the value "11", stored in the memory 21 is latched in the latch circuit 23. The data of the stitch No. 1 will be changed to those of the stitch No. 2 for the second stitch at a rising point of the phase signal PH when the needle 2 ascends above the fabric after completing the first stich. The counter 22 is again reset at the subsequent falling point of the phase signal PH. When the stitching operation is continued to reach the stitch No. 3, the lock stitch signal DT is changed to the low level, thereby making the AND circuit 15 ineffective, and the data remain unchanged for further stitches, until the counter 22 comes to count up eleven falling points of the phase signal PH. Then the comparison circuit 16 produces the high level signal so as to renew the data to those at the stitch No. 4. The counter 22 is again reset at a falling point of the signal from the comparator circuit 16. The darning pattern stitching operation is continuously carried out in the same manner. When the data for stitch No. 19 are reached, the lock stitch signal DT is again made high level and the final lock stitch is produced for the stitch No. 19, which is subsequently changed to the next stitch No. at each rising point of the phase signal PH. When the predetermined number of lock stitches are completed at the stitch No. 23, the high level signal is supplied from the comparator circuit 31 to the brake unit 32 and the control unit 9 respectively, whereby the sewing machine is stopped and the control unit 9 is again back to the initial stage. Thus, the darning pattern as shown in FIG. 2A has been completed.

Next, it is assumed that the turning point designating switch 5 is operated after the first three straight stitches have been made with the data of the stitch No. 3. Then the counter 22 counts up three stitches, which value is latched in the latch circuit 23. The comparator circuit 16 produces the high level signal and therefore the data proceeds to the following stitch No. 4. Then, the counter 22 is reset at the falling point of the phase signal PH to thereby change the signal from the comparator circuit 16 to the low level. Thus, the darning pattern stitches as shown in FIG. 2B may be produced by operation of the memory switch 6 during the darning operation.

While the invention has been described in conjunction with specific embodiments thereof, it is to be understood that many variations and modifications thereof may be made without departing from spirit and scope of the invention as defined in the appended claims.

What is claimed is:

1. An electronic sewing machine of the type having a rotatable drive shaft to reciprocate vertically a laterally swingable needle for penetrating a fabric to be sewn and form stitches thereon, comprising:

a first electronic memory for storing stitch control data to control the needle position and a fabric feed amount per stitch of a pattern selected from a number of different patterns including a darning pattern, said darning pattern being comprised of plural series of straight stitch lines sequentially and alternately produced in forward and reverse fabric feeding directions, said stitch lines being laterally spaced from each other by a predetermined distance within a maximum range which said needle can swingably traverse, said stitch control data including first data defining a fixed number of stitches at initial and final portions of said darning pattern and second data defining said straight stitch lines each of which can be produced continuously as long as the sewing machine is driven;

pattern selecting means including a pattern selecting switch operative to produce a pattern signal designating said darning pattern;

pattern signal control means responsive to said pattern signal to latch the same and produce a start signal and an initial address signal for addressing said memory, to read out sequentially the data for said selected pattern;

pulse signal generating means operated in synchronism with rotation of said drive shaft to produce a timing signal for reading out the data of the selected pattern from said memory;

counter means responsive to said start signal and adapted to be reset to count a number of said timing signals produced by said pulse signal generating means;

data discriminating means operated in response to said first data to produce a signal for making effective each timing signal of said pulse signal generating means, said data discriminating means being responsive to said second data to produce a signal for nullifying said timing signal to said memory and simultaneously resetting said counter means for starting the counting operation;

switch means operated to designate a turning point of each series of said straight stitch lines of said darning pattern;

a latch circuit responsive to operation of said switch means to latch the number of said timing signals counted by said counter means; and means for comparing said number of timing signals latched by said latch circuit and a number of said timing signals counted by said counter means, said comparing means being operated when the counted number coincides with the latched number to make effective said timing signal to said memory, and simultaneously to reset said counter means for starting the count operation.

2. The electronic sewing machine as defined in claim 1, further comprising a second memory for storing a predetermined maximum number of said timing signals to be stored by said latch circuit.

3. The electronic sewing machine as defined in claim 1, further comprising second comparing means for comparing each of said data read out from said first electronic memory and said initial data, said second comparing means producing an accord signal when said data read out from said first electronic memory coincides with said initial data; and braking means operated in response to said accord signal to stop operation of said sewing machine.

* * * * *